US005732833A

United States Patent [19]

Alvarado et al.

[11] Patent Number: 5,732,833

[45] Date of Patent: Mar. 31, 1998

[54] PLASTIC BAG DISPENSING ASSEMBLY

[75] Inventors: Rafael A. Alvarado, Houston, Tex.; Francis Charles Ritter, Great Neck, N.Y.; Kim L. Burnett, Houston, Tex.

[73] Assignee: Better Bags, Inc., Houston, Tex.

[21] Appl. No.: 685,371

[22] Filed: Jul. 23, 1996

[51] Int. Cl.[6] ..... A47F 5/00

[52] U.S. Cl. ..... 211/59.1; 211/50; 211/163; 206/554

[58] Field of Search ..... 211/57.1, 59.1, 211/163, 50; 206/554

[56] References Cited

U.S. PATENT DOCUMENTS

| | | | |
|---|---|---|---|
| 1,002,639 | 9/1911 | Broussard | 211/57.1 |
| 2,682,956 | 7/1954 | Pike | 211/59.1 X |
| 3,285,407 | 11/1966 | Abramson | 206/554 X |
| 3,827,571 | 8/1974 | Koutny | 211/59.1 |
| 4,542,827 | 9/1985 | Pilzer | 206/554 X |
| 5,038,946 | 8/1991 | Tenser et al. | 206/554 X |
| 5,060,809 | 10/1991 | Bayes et al. | 211/59.1 |
| 5,060,897 | 10/1991 | Thalenfeld | 211/57.1 X |
| 5,119,968 | 6/1992 | Palmer | 206/554 X |
| 5,332,097 | 7/1994 | Wile | 206/554 |
| 5,450,964 | 9/1995 | Miller | 206/554 |

*Primary Examiner*—Robert W. Gibson, Jr.

*Attorney, Agent, or Firm*—Pravel, Hewitt, Kimball & Krieger

[57] ABSTRACT

A floor standing dispensing assembly for supporting a plurality of packs of plastic bags. The floor standing dispensing assembly includes a vertical member attached to a base member. A support hook includes a horizontal segment, an inclined planer segment and an attachment segment for attaching to the vertical member. A bag closure dispenser is mounted to the vertical member. A backing bar for providing support across the width of the plastic bags is attached to the vertical member. A header is connected to the plastic bags. The header includes an elongate opening therethrough to fit onto the support hook. The header is made from a substantially rectangular piece of material having a handle formed from a generally central area of the rectangular piece. The header includes continuous front and back flanges along the length of header. The header fits onto the inclined segment of the support hook and the back flange contacts the backing bar. The dispensing assembly also includes an outer frame having a plurality of clips attached for hanging various articles and products.

13 Claims, 3 Drawing Sheets

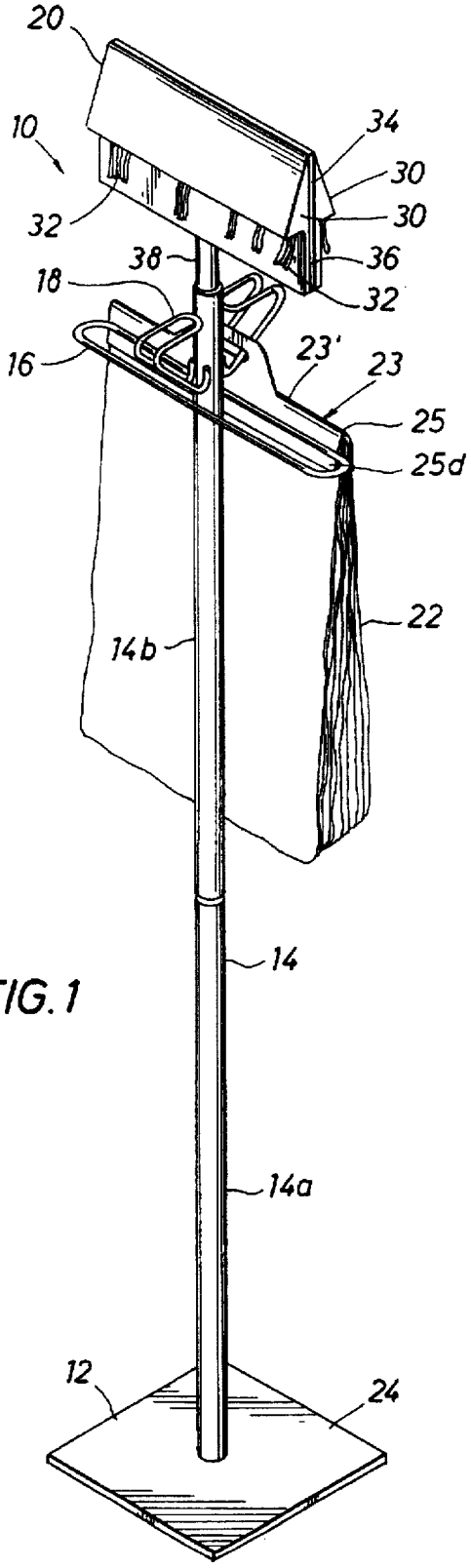
FIG. 1
FIG. 2
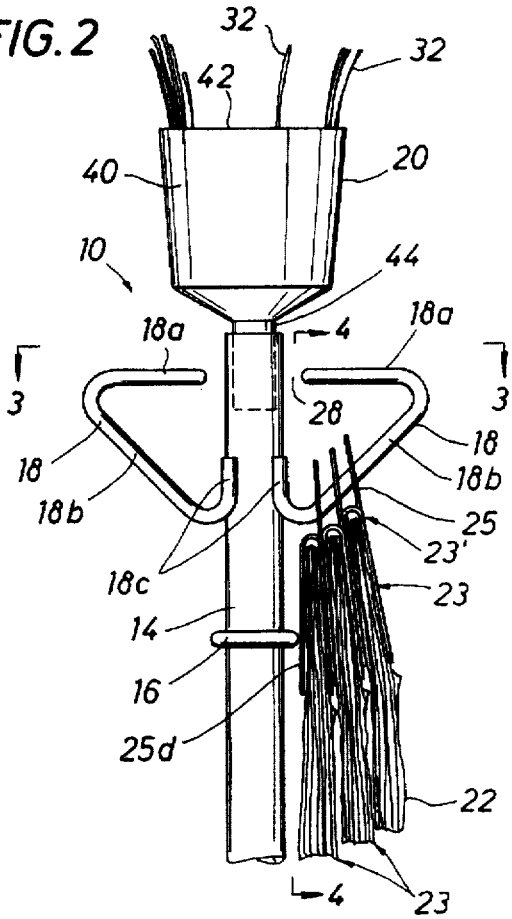
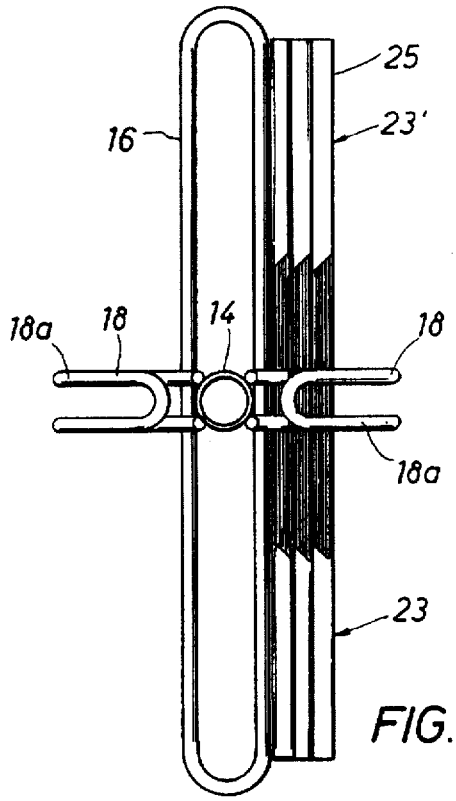
FIG. 3

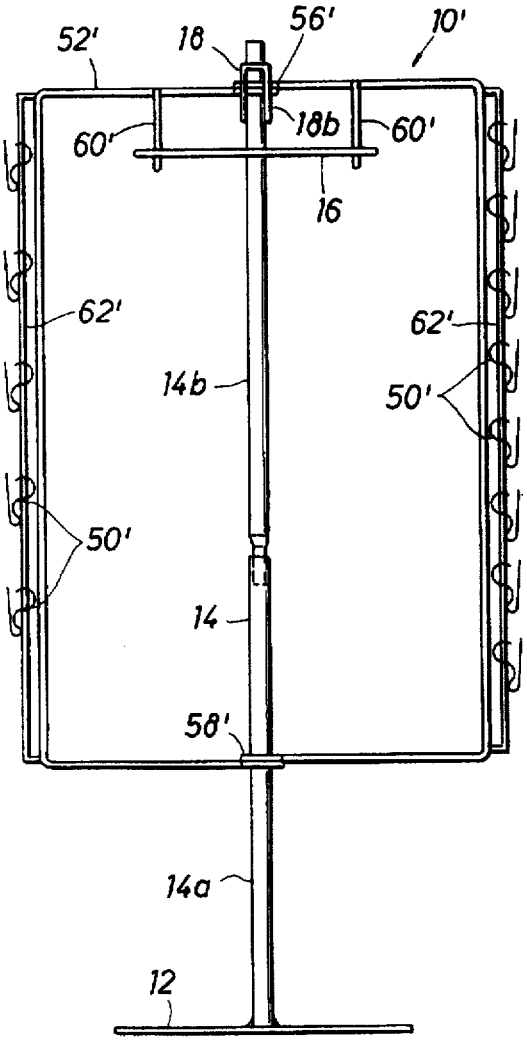
FIG. 9
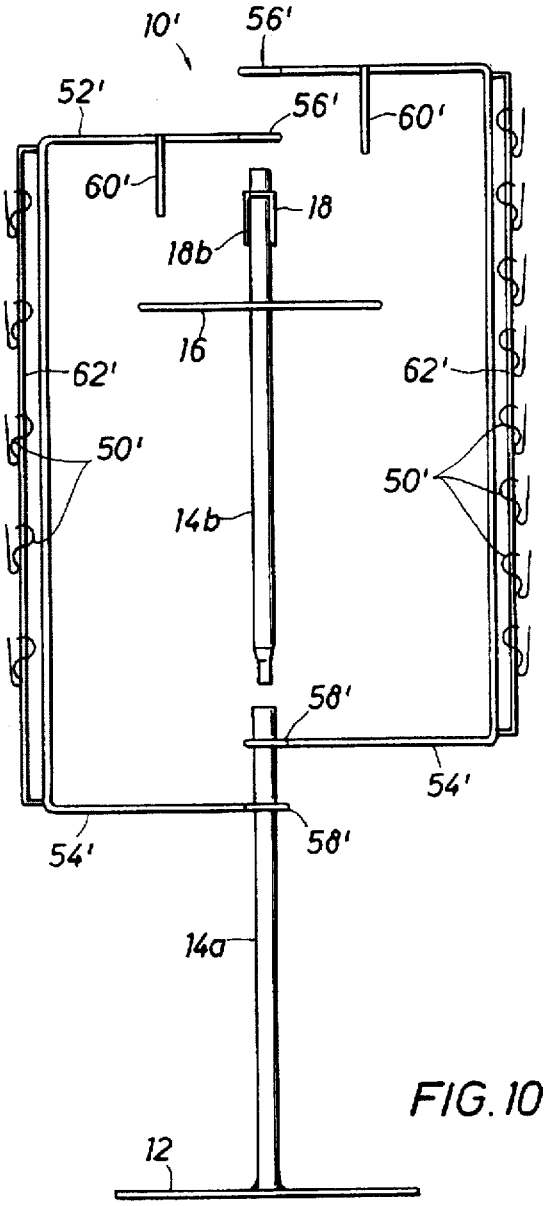
FIG. 10
FIG. 11
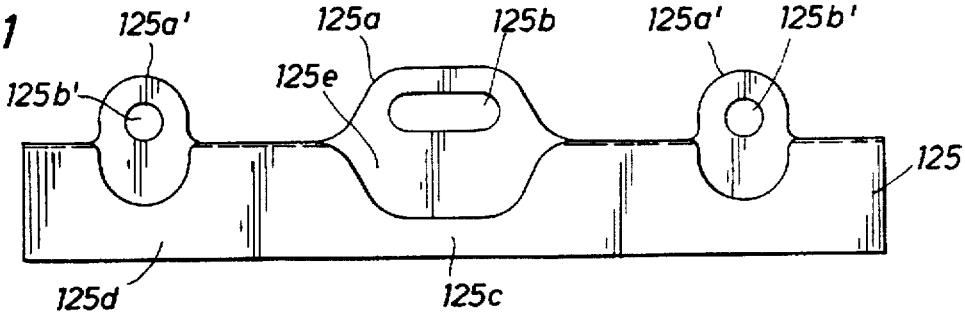

PLASTIC BAG DISPENSING ASSEMBLY

BACKGROUND OF THE INVENTION

1. Field of the Invention

The present invention relates generally to dispensing assemblies for plastic bags, and more particularly to a floor standing dispensing assembly for plastic bags.

2. Description of the Prior Art

Plastic bags for customer use and convenience are commonly available in many types of retail stores, most commonly in grocery stores and supermarkets. The plastic bags are available in the grocery store for the customer to put various items of produce in, for example, items such as apples, peaches, oranges, vegetables, etc.

The plastic bags are sometimes manufactured in a continuous roll with a perforation between the adjacent bags. The roll of plastic bags is typically supported on a dispensing apparatus mounted to or above the produce counter.

It is also known in the art to manufacture and assemble the plastic bags in packs which are then dispensed from a floor standing dispensing assembly. This pack of plastic bags includes a disposable upper portion connected to the lower plastic bag. A perforation is made between the upper portion and the lower plastic bag. The upper portion is attached to the dispensing assembly. When a customer wants to use a plastic bag, he pulls on the lower plastic bag and tears it away from the upper portion at the perforation.

Typically, a plurality of plastic bags are stacked together to form a pack of approximately 50 bags. The pack of plastic bags are held together at the disposable upper portion. Most commonly, the pack of plastic bags are held together by removably inserting a plurality of heated blunt rods through the disposable upper portion of the stack of plastic bags to melt the upper portions together about the insertion points of the heated blunt rods.

The packs of plastic bags are mounted on the floor standing dispensing assemblies, typically, in one of two ways. One way of mounting has been to attach a plastic hanger, generally referred to as a header, to the disposable upper portions of the pack of plastic bags. The header includes an upper circular opening through which a supporting member of the floor standing dispensing assembly extends to support the header pack of plastic bags. This type of plastic bag pack is commonly referred to as "header bags." A second way of mounting is to make a pair of circular holes through the disposable upper portion of the plastic bag and hang or suspend the plastic bags by inserting a supporting member through each of the holes. This type of plastic bag pack is commonly referred to as "headerless bags." Several packs of header bags or headerless bags will typically be hung or supported on the floor standing dispensing assembly at one time.

In the past, the supporting member or members have typically been substantially straight, horizontal members or members shaped in a generally vertical, circular manner. The horizontal mounting members are not desirable due to the potential danger to a customer or child. Horizontal mounting members also make it easy for dishonest customers to slip a pack of the plastic bags off of the dispensing assembly and steal entire packs of plastic bags. The generally circular mounting members have an upper opening to permit the pack of plastic bags to be mounted to the dispensing assembly. The generally circular mounting members are safer and provide more theft deterrence than the horizontal mounting members. However, the rounded circular mounting members do not maintain the plastic bags in such a way that the outermost plastic bag opening is readily apparent to the customer.

With the headerless bags, the bags are supported at two points and hang in a vertical manner from the floor standing dispensing assembly. Alternatively, the header bags supported at one point via a circular hole often results in the adjacent packs not hanging vertically and makes for an unattractive display. Additionally, the header bags typically curl about the vertical axis as opposed to hanging in a substantially planer vertical fashion. This is due to the fact that the pack is flimsy and is supported at a single point along the centerline of the pack of header bags.

It is important to the business establishment that the floor standing dispensing assembly require a minimal amount of space, be stable, not be an eyesore, not pose a danger to customers, and be relatively easy to stock with packs of plastic bags. The floor standing dispensing assembly should also be convenient and user-friendly to the customer. The dispensing assembly should provide convenient access to bag closures, often referred to as "twist ties." Furthermore, the dispensing assembly should present the plastic bags in a manner such that the customer will automatically be able to tear off a single bag and find the bag opening without any hassle.

It is desirable to have a floor standing dispensing assembly for supporting a plurality of packs of plastic bags which is pleasing to the eye, stable, and inexpensive. It is also desirable that the plastic bags be easily accessible to the customer and convenient to use. It is desirable that the supporting member(s) for the plastic bags do not pose a risk of injury to the customers or children. It is also desirable that the floor standing dispensing assembly does not allow a thief to easily and inconspicuously steal one or more packs of plastic bags. It is desirable that the floor standing dispensing assembly provides for neat and orderly presentation of the packs of plastic bags. The floor standing dispensing assembly should also provide for convenient access to bag closures for the bags when used by the customer. Additionally, it is desirable to have a floor standing dispensing assembly which is also capable of supporting articles which the customer may desire to put in the plastic bag.

SUMMARY OF THE INVENTION

The present invention is a floor standing dispensing assembly for supporting a plurality of packs of plastic bags. The floor standing dispensing assembly includes a vertical member attached to a base member. A support hook includes a horizontal segment, an inclined planer segment and an attachment segment for attaching to the vertical member. A bag closure dispenser is mounted to the vertical member. A backing bar for providing support across the width of the plastic bags is attached to the vertical member.

A header is connected to the plastic bags. The header includes an elongate opening therethrough to fit onto the support hook. The header is made from a substantially rectangular piece of material having a handle formed from a generally central area of the rectangular piece. The header includes continuous front and back flanges along the length of header. The header fits onto the inclined segment of the support hook and the back flange contacts the backing bar.

The floor standing dispensing assembly is pleasing to the eye, stable, and inexpensive to fabricate. The plastic bags are easily accessible to the customer and convenient to use. The support hooks of the floor standing dispensing assembly do not pose a risk of injury to the customers or children. The present invention does not allow a thief to easily and inconspicuously steal one or more packs of plastic bags. The floor standing dispensing assembly provides for neat and orderly presentation of the packs of plastic bags and also provides for convenient access to bag closures for the bags when used by the customer. The floor standing dispensing assembly also includes a plurality of clips for supporting various articles which the customer may wish to remove from the dispensing assembly and include in the customer's plastic bag.

BRIEF DESCRIPTION OF THE DRAWINGS

In order to more fully understand the drawings referred to in the detailed description of the present invention, a brief description of each drawing is presented, in which:

FIG. 1 is a perspective elevational view of the floor standing dispensing assembly of the present invention;

FIG. 2 is a partial side elevational view of the floor standing dispensing assembly shown in FIG. 1;

FIG. 3 is a view taken along line 3—3 of FIG. 2;

FIG. 9 is a front elevational view of another embodiment of the floor standing dispensing assembly of the present invention;

FIG. 10 is an exploded view of the floor standing dispensing assembly shown in FIG. 9; and FIG. 11 is a front elevational view of an alternate header.

DETAILED DESCRIPTION OF PREFERRED EMBODIMENT

Figure 4:
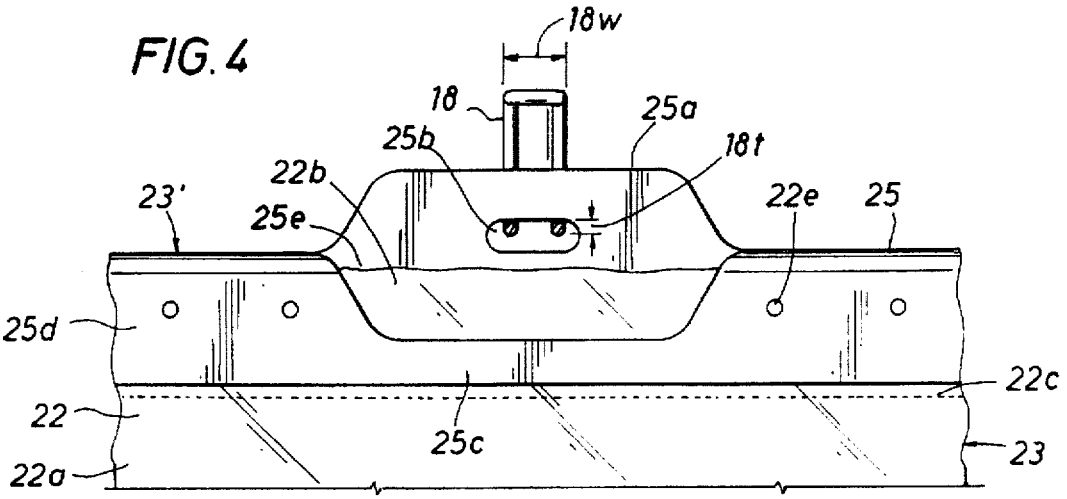
FIG. 4 is a view taken along line 4—4 of FIG. 2.

Referring now to the drawings in greater detail, the floor standing dispensing assembly of the present invention, generally designated by the number 10, includes a base 12, an elongate vertical tubular member 14, a backing bar 16, a support hook 18, and a bag closure dispenser 20. The floor standing dispensing assembly 10 is designed to support and dispense plastic bags 22.

Figure 8:
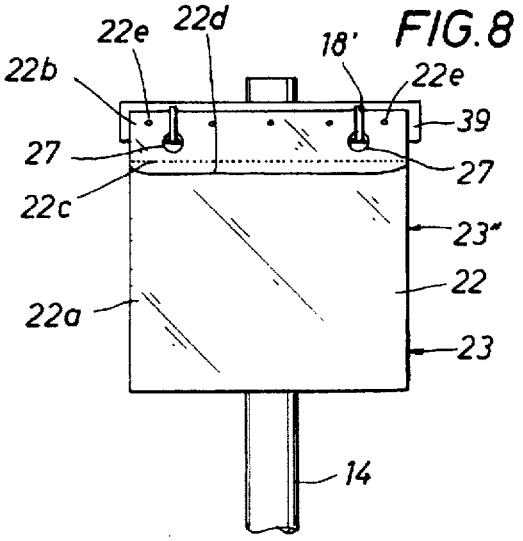
FIG. 8 is a partial elevational view showing a headerless bag assembly supported by the floor standing dispensing assembly.

As shown in FIGS. 4 and 8, the plastic bags 22 include a lower bag portion **22*a* and a disposable upper portion 22*b*. A perforation 22*c* is made along the width of the plastic bag 22 between the upper portion 22*b* and the lower bag portion 22*a*. The plastic bags 22 include an upwardly-facing opening 22*d* as shown in FIG. 8. Typically, a plurality of plastic bags 22 are stacked on top of one another to form a pack 23 of approximately 50 bags. Typically, the pack 23 is held together by removably inserting a plurality of heated blunt rods through the upper portion 22*b* of the stack of plastic bags 22 to melt the upper portions 22*b* together about the points of insertion 22*e*** of the heated blunt rods.

As discussed in the BACKGROUND OF THE INVENTION, the packs 23 of plastic bags are mounted, suspended or attached to the floor standing dispensing assembly 10 by the disposable upper portion **22*b* as shown in FIG. 8, via a header 25 attached to the disposable upper portion 22*b* as shown in FIGS. 1–4, or via a header 125 as shown in FIG. 11. For purposes of distinguishing between the types of packs, the header pack shown in FIGS. 1–4 will be referenced as 23' and the headerless pack shown in FIG. 8 will be referenced as 23". Although not shown, it is to be understood that a header pack 23' can also be formed in the same manner with the header 125 shown in FIG. 11. Reference numeral 23** will be used to generally reference packs of plastic bags.

Referring to FIGS. 1, 9 and 10, the elongate vertical tubular member 14 attaches at its lower end to the base 12 and has an upper end to which is attached the backing bar 16, the support hooks 18, and the bag closure dispenser 20 (FIG. 1). It is to be understood that the tubular member 14 can be made of a round tubular member but may also be made of other shapes, as for example from square tubular material. In the preferred embodiment, the vertical elongate tubular member 14 is a hollow member for reasons which will be explained below. With reference to FIGS. 1, 9 and 10, the elongate vertical tubular member 14 is shown as having a lower tubular member 14a and an upper tubular member **14*b* which are joined together to form the vertical elongate tubular member 14. It is desirable to have the elongate tubular member 14** in two or more pieces to facilitate packaging and shipping.

Figure 5:
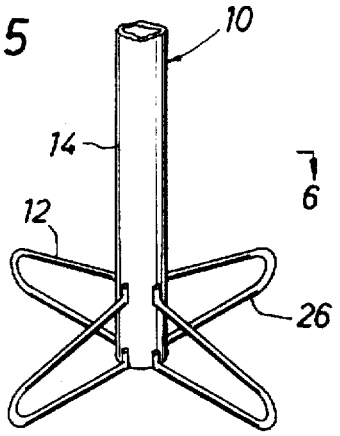
FIG. 5 is a perspective, partial elevational view of an alternate base configuration for the floor standing dispensing assembly.
Figure 6:
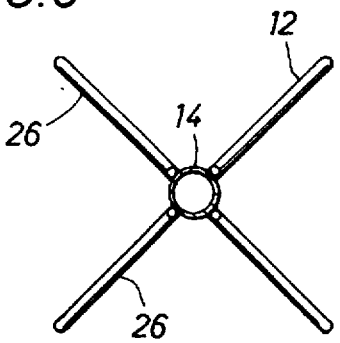
FIG. 6 is a view taken along lines 6—6 of FIG. 5.

Referring to FIGS. 1, 9 and 10, the base 12 prevents the floor standing dispensing assembly 10 from overturning. In FIGS. 1, 9 and 10, the base 12 is shown as a flat plate 24, preferably square or rectangular in shape. It is to be understood that various other types of bases could be used and are contemplated as being within the scope of the present invention. In FIGS. 5 and 6, one alternative base 12 is shown. The alternative base 12 is comprised of wire loops 26 forming legs to stabilize the floor standing dispensing assembly 10. Preferably, the wire legs 26 collapse to facilitate shipping.

Referring to FIGS. 1–4, 9 and 10, the support hooks 18 are securely connected to the upper portion of the elongate tubular member 14 as for example, by welding. In the embodiments shown in FIGS. 1–4, 9 and 10, a pair of support hooks are diametrically attached to the elongate tubular member 14.

With reference to FIG. 2, the support hooks 18 include a generally horizontal upper segment **18*a*, an inclined planer segment 18*b*, and an attaching segment 18*c* for attaching the support hook 18 to the elongate tubular member 14. As shown in FIGS. 1, 3, 9 and 10, the support hooks 18 may be formed from a substantially rigid wire. Referring to FIG. 4, preferably the support hook 18 has a horizontal width 18*w* that is substantially greater than a vertical thickness 18*t* of the support hook 18 for reasons which will be explained below. Alternatively, the support hooks 18 could be formed from substantially rigid plate material bent into the general configuration as shown in the side view of FIG. 2. The horizontal segment 18*a* extends towards the elongate tubular member 14 but forms a gap 28 therebetween. The gap 28 allows the packs 23 of plastic bags 22 to be placed onto the support hooks 18** as will be explained below.

Referring to FIGS. 1–4, the header 25 according to the present invention for the header packs 23' is a single piece construction made of plastic. The header 25 is formed by cutting a flat, generally rectangular plastic piece to form a header handle **25*a* along a longitudinal fold line as shown in FIG. 4. The header 25 is attached to the disposable upper portion 22*b* of the pack 23 of plastic bags by means well known in the industry. One such means of attaching is by inserting heated blunt rods through the header 25 and the stack of plastic bags 22 as described above to form the header pack 23'**.

Referring to FIG. 4, the header 25 includes an opening **25*b* which is preferably an elongate opening. The elongate opening 25*b* is centrally located along the length of the header 25. The elongate opening 25*b* is large enough to permit the opening 25*b* to extend over the support hook 18. Preferably, the elongate opening 25*b* is sized to closely fit over the support hook 18 so that the header pack 23' will tend to remain in a normal vertically hung position. The closely fitting elongate opening 25*b* provides resistance to lateral tilting or cocking of the header pack 23'. Additionally, the two contact points of the support hook 18 with the header 25 also functions to normally orient the header pack 23'** in a vertical orientation.

The design of the header 25 as shown in FIG. 4 also provides certain other advantages over prior art headers. The length of the header handle 25 relative to the length of the elongate opening **25*b* is preferably in the range of 3:1 to 5:1 which provides sufficient material around the opening 25*b* to maintain the handle 25 in a generally planer condition. Also, a rib 25*c* (FIG. 4) remaining along the length of a back flange 25*d* of the header 25 at the point where the handle 25*a* was formed provides header rigidity and resistance to bending. The header 25 also includes a continuous front flange 25*e*. These features tend to eliminate any tendency of the header pack 23' to curl about the vertical axis of the header pack 23'**.

Similarly, the alternate header 125 (FIG. 11) according to the present invention for the header packs 23' is a single piece construction made of plastic. The header 125 is formed by cutting a flat, generally rectangular plastic piece to form a central header handle **125*a* and a pair of upper tabs 125*a*' along a longitudinal fold line as shown in FIG. 11. Although not shown, the header 125 is attached to the disposable upper portion 22*b* of the pack 23** of plastic bags by means well known in the industry and as described above.

Referring to FIG. 11, the central header handle **125*a* includes an opening 125*b* which is preferably an elongate opening. The elongate opening 125*b* is centrally located along the length of the header 125. The elongate opening 125*b* is large enough to permit the opening 125*b* to extend over the support hook 18. Preferably, the elongate opening 125*b* is sized to closely fit over the support hook 18 so that the header pack 23' will tend to remain in a normal vertically hung position. The closely fitting elongate opening 125*b* provides resistance to lateral tilting or cocking of the header pack 23'. Additionally, the two contact points of the support hook 18 with the header 125 also functions to normally orient the header pack 23'** in a vertical orientation.

Figure 7:
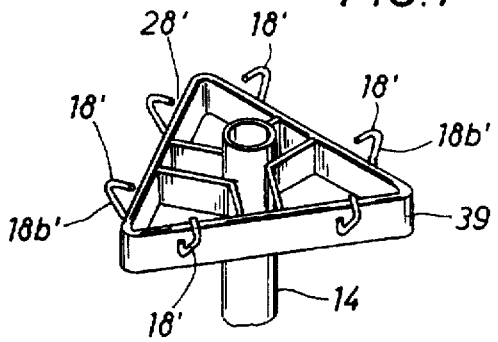
FIG. 7 is a perspective elevational view in partial section of an alternative bag support assembly.

Referring to FIG. 11, each of the upper tabs **125*a*' is spaced equidistantly from the center of the header 125. Each upper tab 125*a*' includes a hole 125*b*' which is large enough to permit a support hook 18' as shown in FIG. 7 to extend through the hole 125*b*'. The two spaced holes 125*b*' provide a pair of contact points with the support hooks 18' and functions to normally orient the header pack 2' in a vertical orientation. The alternate header 125 allows for the header pack 23' to be hung either from a center support bracket 18 (FIGS. 1–4, 9 and 10) or from a pair of side support brackets 18' (FIG. 7**).

Still referring to FIG. 11, a rib **125*c* remaining along the length of a back flange 125*d* of the header 125 at the point where the handle 125*a* was formed provides header rigidity and resistance to bending. The header 125 also includes a continuous front flange 125*e*. These features tend to eliminate any tendency of the header pack 23' to curl about the vertical axis of the header pack 23'**.

Referring to FIG. 8, the headerless packs 23" are suspended from the floor standing dispensing assembly 10 from a pair of support hooks 18'. Preferably, the support hooks 18' have the same general shape as the support hooks 18 for reasons which will be explained below. The headerless pack 23" includes a pair of holes 27 spaced equidistantly from the centerline of the plastic bag 22. The support hooks 18' are secured to a frame member 39 which is firmly secured to the elongate tubular member 14. The embodiment shown in FIGS. 7 and 8 includes three pairs of support hooks 18' to support headerless packs 23" along three faces of the frame member 39. It is to be understood that the present invention is not limited to the embodiments disclosed in the drawings but the embodiments shown in the drawing are intended to be illustrative of the various embodiments contemplated by the inventor.

Referring to FIGS. 2, 9 and 10, the inclined segment **18*b* of the support bracket 18 results in the packs 23 of plastic bags stacking against one another and forming a neat and orderly appearance. The plastic bags 22 also naturally lie flat against one another and compress themselves naturally due to the inclined segment 18*b*. The inclined segment 18*b*' (FIG. 7) of the support hook 18'** also performs the same function.

Referring to FIGS. 1–3, 9 and 10, the backing bar 16 is a substantially rigid wire forming an elongate loop about the elongate vertical member 14. The backing bar 16 is rigidly attached to the elongate vertical member 14. Preferably, the backing bar 16 is vertically positioned on the elongate vertical member 14 such that it contacts the back flange **25*d*, 125*d* of the header 25, 125, respectively, as shown in FIGS. 1 and 2. Preferably, the backing bar 16 extends substantially the length of the header 25 as shown in FIGS. 1 and 3**.

The backing bar 16 provides support to the header pack 23' and helps to maintain the header pack 23' in a substantially planer condition which is pleasing to the eye. Referring to FIGS. 2 and 3, the backing bar 16 maintains a plurality of header packs 23' in a neat, planer condition. As indicated above, the inclined segment **18*b* causes the plurality of packs 23' to stack closely together and the backing bar 16 maintains the packs 23' in a neat and orderly fashion. The backing bar 16 in conjunction with the inclined segment 18*b* also serve to slightly project the opening 22*d* of the plastic bag 22 towards the customer which enhances and simplifies tearing off and opening of the plastic bag 22 by the customer. Although the backing bar 16 has not been shown in FIGS. 7 and 8, it is to be understood that the backing bar 16 is similarly applicable for the headerless packs 23"**.

It is to be noted that in FIGS. 1 and 2, two different types of bag closure dispensers 20 are shown. In FIG. 1, a pair of bag closure dispensers 30 are shown for dispensing bag closures 32. The bag closure dispenser 30 is commercially available from Twist-Ease, Inc., of Minneapolis, Minn., and is sold under the registered trademark TWIST-EASE. This bag closure dispenser 30 is disclosed in U.S. Pat. Nos. 4,948,202, 5,092,830, and U.S. Pat. No. Des. 323,594. The pair of bag closure dispensers 30 shown in FIG. 1 include a back surface 34 which has an adhesive strip (not shown) applied thereto. The adhesive strip is adhered to a flat mounting plate 36 as shown in FIG. 1. Preferably, the mounting plate 36 has a centrally located post 38 which attaches to the elongate tubular vertical member 14. Preferably, the post 38 stabs into the end of the upper tubular member **14*b***.

Alternatively, the bag closure dispenser 20 shown in FIG. 2 comprises a receptacle 40 having an upwardly-facing opening 42. The receptacle 40 is adapted to contain a plurality of loose bag closures 32 as shown in FIG. 2. Preferably, a centrally located post 44 extends from the bottom of the receptacle 40 and is adapted to stab into the end of the upper tubular member **14*b***.

Referring to FIGS. 9 and 10, another embodiment of the floor standing dispensing assembly, generally designated as 10', is shown. The floor standing dispensing assembly 10' includes many of the same features and components as described above. The floor standing dispensing assembly 10' includes a plurality of clips 50' mounted on an outer frame assembly 52'. The outer frame assembly 52' is formed of substantially rigid wire which is bent into a generally rectangular shape as shown in FIG. 9. Preferably, the outer frame assembly 52' is formed of a pair of frame half sections 54' as best shown in FIG. 10. Each frame half section 54' includes an upper and lower eye 56' and 58', respectively. The eye 56', 58' include an opening (not shown) sized slightly larger than the diameter of the elongate tubular member 14. The frame half section 54' includes a downwardly extending stabilizing member 60' which extends through the elongate loop of the backing bar 16 to prevent the frame half section 54' from rotating about the elongate tubular member 14. Preferably, the stabilizing member 60' is formed of substantially rigid wire which is attached to opposite sides of the wire forming the frame half section 54'. The upper eyes 56' of the frame half sections 54' are supported by the attaching segment **18*c* (FIG. 2) of the support hook 18. The upper eyes 56' bear against the upper end of the attaching segment 18*c* to vertically position the outer frame assembly 52'**.

Referring to FIGS. 9 and 10, the plurality of clips 50' are mounted on a clip bar 62' attached to the outer frame assembly 52'. The clips 50' are preferably a small spring clip which can support light items. It is to be understood that the clips 50' are provided to hang small packages, products or other articles which would be conveniently located with products to be placed into the plastic bags 22. It is to be understood that the orientation of the clips 50' could be arranged in various positions and is not limited to the position as shown in the drawings.

The assembly of the floor standing dispensing assembly 10' will now be described with reference to FIG. 10. The lower eyes 58' of the frame half sections 54' are lowered onto the lower tubular member **14*a*. The upper tubular member 14*b* with the backing bar 16 and the support hooks 18 is mated with the lower tubular member 14*a*. The upper eyes 56' of the frame half sections 54' are lowered onto the upper tubular member 14*b*. Preferably, the upper eyes 56' are lowered onto the upper tubular member 14*b* in the same order as the lower eyes 58' are lowered onto the lower tubular member 14*a* as shown in FIGS. 9 and 10. The stabilizing members 60' are inserted through the loop of the backing bar 16 as the frame half sections 54' come to rest against the attaching segments 18*c* of the support hooks 18. Although not shown in FIGS. 9 and 10, a bag closure dispenser 20 of the type shown in FIGS. 1 or 2 can be mounted to the upper end of the vertical tubular member 14**.

It is to be understood that the header 25, 125 and/or disposable upper portion **22*b* must be inverted to mount a pack 23 of plastic bags onto the support hook 18 or support hooks 18'. The same is true for removing a pack 23 from the floor standing dispensing assembly 10, 10'. This feature makes it difficult for the would-be thief to quickly, easily and inconspicuously remove a pack 23 from the dispensing assembly 10, 10' while still permitting the stocking person to stock the dispensing assembly 10, 10' without undue difficulty. The smaller the gap 28 between the support hook 18 and the elongate tubular member 14 and the gap 28' (FIG. 7) between the support hook 18' and the frame member 39 the more of a theft deterrent is provided. Certainly, the minimum gap 28 and 28' is limited by the thickness of the header 25, 125 and the thickness of the headerless pack 23", respectively. With respect to the floor standing dispensing assembly 10', the minimum gap 28 is limited to the thickness of the wire forming the upper eye 56'**.

The foregoing disclosure and description of the invention is illustrative and explanatory thereof, and various changes in the size, shape, and materials, as well as in the details of illustrative construction and assembly, may be made without departing from the spirit of the invention.

We claim:

1. A floor standing dispensing assembly for dispensing plastic bags, the dispensing assembly comprising:

a base member;

a vertical member attached to said base member;

a support hook comprising:

an attachment segment for attaching to said vertical member;

an inclined planer segment; and a substantially horizontal segment;

an outer frame assembly attached to said vertical member; and a plurality of dips mounted to said outer frame assembly.

2. The dispensing assembly of claim 1, wherein said outer frame assembly comprises a pair of frame half sections with each said frame half section having a plurality of clips mounted thereto.

3. A dispensing assembly for dispensing plastic bags of the type stacked onto one another and having a lower bag portion and a disposable upper portion, the dispensing assembly having a plurality of support hooks for supporting the stack of plastic bags, wherein the improvement comprises:

a header connected to the disposable upper portion of the stack of plastic bags, said header is made from a substantially rectangular piece of plastic having a handle formed from a generally central area of said substantially rectangular piece with said substantially rectangular piece folded longitudinally, said header having a continuous front flange and a continuous back flange along the length of said header, said header including a pair of upper tabs, each said upper tab having a hole therethrough for hanging the stack of plastic bags.

4. The dispensing assembly of claim 3, wherein said header has an elongate opening through said handle for hanging the stack of plastic bags.

5. A floor standing dispensing assembly for dispensing plastic bags, the dispensing assembly comprising:

a base member;

a vertical member attached to said base member;

a support hook comprising:

an attachment segment for attaching to said vertical member;

an inclined planer segment; and a substantially horizontal segment; and a header having an elongate opening therethrough to fit onto said support hook, said header made from a substantially rectangular piece of plastic having a handle formed from a generally central area of said substantially rectangular piece with said substantially rectangular piece folded longitudinally, said header having a continuous front flange and a continuous back flange along the length of said header, wherein said header fits onto said inclined segment and said back flange contacts said backing bar.

6. A plastic bag dispensing assembly for dispensing plastic bags, the dispensing assembly comprising:

a support assembly including a support hook, said support hook comprising:

an inclined planer segment; and a substantially horizontal segment;

a header having an elongate opening therethrough to fit onto said support hook, wherein said header fits onto said inclined segment.

7. A plastic bag dispensing assembly for dispensing plastic bags, the dispensing assembly comprising:

a support assembly including a support hook, said support hook having a horizontal width that is substantially greater than a vertical thickness;

a header having an elongate opening therethrough to fit onto said support hook, said elongate opening of said header is horizontal such that said header hangs horizontally on said support hook.

8. A plastic bag dispensing assembly for dispensing plastic bags, the dispensing assembly comprising:

a support assembly including a support hook;

a header having an elongate opening therethrough to fit onto said support hook;

an outer frame assembly attached to said support assembly; and a plurality of clips mounted to said outer frame assembly.

9. The dispensing assembly of claim 8, wherein said outer frame assembly comprises a pair of frame half sections with each said frame half section having a plurality of clips mounted thereto.

10. The dispensing assembly of claim 7, wherein said support assembly further comprises:

a base member; and a vertical member attached to said base member, wherein said support hook is attached to said vertical member.

11. The dispensing assembly of claim 10, wherein said support hook includes a substantially horizontal segment and a gap is formed between said horizontal segment and said vertical member.

12. The dispensing assembly of claim 10, wherein said support assembly further comprises a backing bar attached to said vertical member.

13. The dispensing assembly of claim 12, wherein said header includes a continuous back flange and said back flange contacts said backing bar.

* * * * *

Disclaimer 5,732,833—Rafael A. Alvarado, Houston, Tex; Francis Charles Ritter, Great Neck, N.Y.; Kim L. Burnett, Houston, Tex. PLASTIC BAG DISPENSING ASSEMBLY. Patent dated March 31, 1998. Disclaimer filed May 14, 2002 by the assignee, Better Bags, Inc.

Hereby enters this disclaimer to claims 5-7 and 10-13.

*(Official Gazette, August 13, 2002)*

US005732833C1

(12) REEXAMINATION CERTIFICATE (4834th)

United States Patent

Alvarado et al.

(10) Number: US 5,732,833 C1

(45) Certificate Issued: Aug. 19, 2003

(54) PLASTIC BAG DISPENSING ASSEMBLY

(75) Inventors: Rafael A. Alvarado, Houston, TX (US); Francis Charles Ritter, Great Neck, NY (US); Kim L. Burnett, Houston, TX (US)

(73) Assignee: Better Bags, Inc., Houston, TX (US)

Reexamination Request:
No. 90/006,114, Sep. 24, 2001

Reexamination Certificate for:

| | |
|---|---|
| Patent No.: | **5,732,833** |
| Issued: | **Mar. 31, 1998** |
| Appl. No.: | **08/685,371** |
| Filed: | **Jul. 23, 1996** |

Disclaimer of Claims 5, 6, 7, 10, 11, 12, 13 Filed: May 14, 2002. (1261 O.G. 147)

(51) Int. Cl.[7] ..... A47F 5/00

(52) U.S. Cl. ..... 211/59.1; 211/50; 211/163; 206/554

(58) Field of Search ..... 211/59.1, 50, 163, 211/57.1; 206/554

(56) References Cited

U.S. PATENT DOCUMENTS

| | | | |
|---|---|---|---|
| 3,245,547 A | 4/1966 | Felkay | 211/59 |
| 3,799,357 A | 3/1974 | Govang | 211/59 |
| 3,815,756 A | 6/1974 | Cox | 211/57 |
| 3,967,346 A | 7/1976 | Young et al. | 24/73 |
| 4,094,415 A | 6/1978 | Larson | 211/57.1 |
| 4,146,204 A | 3/1979 | Thalenfeld | 248/220.4 |
| 4,245,414 A | 1/1981 | Shypula | 40/124 |
| 4,291,810 A | 9/1981 | Rubenstein | 211/89 |
| 4,351,440 A | 9/1982 | Thalenfeld | 211/57.1 |
| 4,436,209 A | 3/1984 | Thalenfeld | 211/57.1 |
| 4,461,387 A | 7/1984 | Belokin, Jr. | 211/71 |
| 4,474,351 A | 10/1984 | Thalenfeld | 248/220.4 |
| 4,497,464 A | 2/1985 | Fast | 248/220.3 |
| 4,546,943 A | 10/1985 | Fast | 248/205.3 |
| 4,573,590 A | 3/1986 | Ellis | 211/86 |
| 4,688,683 A | 8/1987 | Thalenfeld et al. | 211/57.1 |
| 4,706,917 A | 11/1987 | Thalenfeld | 248/205.1 |
| 4,762,299 A | 8/1988 | Langelier | 248/220.4 |
| 4,871,135 A | 10/1989 | Thalenfeld | 248/221.4 |
| 4,911,392 A | 3/1990 | Fast | 248/220.3 |
| 4,981,216 A | 1/1991 | Wilfong, Jr. | 206/554 |
| 5,014,949 A | 5/1991 | Niven | 248/220.4 |
| 5,099,674 A | 3/1992 | Nagel | 72/403 |
| 5,115,921 A | 5/1992 | Lavelle | 211/71 |
| 5,255,883 A | 10/1993 | Greenfield | 248/95 |
| 5,269,416 A | 12/1993 | DeMatteis | 211/50 |
| 5,386,916 A | 2/1995 | Valiulis | 211/113 |
| 5,415,370 A | 5/1995 | Valiulis | 248/220.4 |
| 5,423,436 A | 6/1995 | Morrow | 21/59.1 |
| 5,685,432 A | 11/1997 | Maldoff | 206/554 |

*Primary Examiner*—Blair M. Johnson

(57) ABSTRACT

A floor standing dispensing assembly for supporting a plurality of packs of plastic bags. The floor standing dispensing assembly includes a vertical member attached to a base member. A support hook includes a horizontal segment, an inclined planer segment and an attachment segment for attaching to the vertical member. A bag closure dispenser is mounted to the vertical member. A backing bar for providing support across the width of the plastic bags is attached to the vertical member. A header is connected to the plastic bags. The header includes an elongate opening therethrough to fit onto the support hook. The header is made from a substantially rectangular piece of material having a handle formed from a generally central area of the rectangular piece. The header includes continuous front and back flanges along the length of header. The header fits onto the inclined segment of the support hook and the back flange contacts the backing bar. The dispensing assembly also includes an outer frame having a plurality of clips attached for hanging various articles and products.

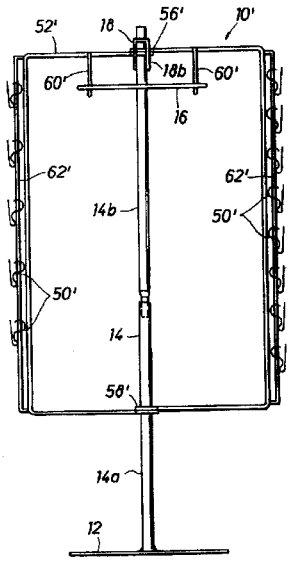

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4, 8 and 9 is confirmed. Claims 5–7 and 10–13 are now disclaimed.

* * * * *